US006644381B1

(12) United States Patent
Cagle et al.

(10) Patent No.: US 6,644,381 B1
(45) Date of Patent: Nov. 11, 2003

(54) CASTING METHOD AND APPARATUS

(75) Inventors: Billy J. Cagle, Indianapolis, IN (US); Paul E. Flick, Indianapolis, IN (US); Arthur D. Parks, Greenfield, IN (US); Edward A. Reelfs, Davenport, IA (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 40 days.

(21) Appl. No.: 09/608,176

(22) Filed: Jun. 30, 2000

Related U.S. Application Data

(60) Provisional application No. 60/142,334, filed on Jul. 2, 1999.

(51) Int. Cl.[7] ..... B22C 25/00; B22D 33/00

(52) U.S. Cl. ..... 164/5; 164/130; 164/137; 164/323; 164/339; 164/394

(58) Field of Search ..... 164/5, 137, 339, 164/341, 394, 395, 396, 409, 322–331, 130

(56) References Cited

U.S. PATENT DOCUMENTS

| | | | | | |
|---|---|---|---|---|---|
| 2,150,589 | A | * | 3/1939 | Rellinger | 164/121 |
| 2,507,158 | A | * | 5/1950 | Hines | 164/395 |
| 2,859,498 | A | * | 11/1958 | Reichert | |
| 2,915,796 | A | * | 12/1959 | Hines | 425/89 |
| 3,060,532 | A | * | 10/1962 | Jones et al. | 164/394 |
| 4,113,001 | A | * | 9/1978 | Workman | 164/255 |
| 4,159,732 | A | * | 7/1979 | Handkammer | 164/339 |
| 4,475,581 | A | * | 10/1984 | Langhammer | 164/100 |
| 4,952,246 | A | * | 8/1990 | Seeley | 134/10 |
| 5,163,500 | A | * | 11/1992 | Seaton et al. | 164/130 |
| 5,238,976 | A | * | 8/1993 | Iyer | 164/526 |
| 5,524,703 | A | * | 6/1996 | Landua et al. | 164/200 |
| 6,244,328 | B1 | * | 6/2001 | Grolla | 164/359 |
| 6,305,460 | B1 | * | 10/2001 | Grolla | 164/119 |

FOREIGN PATENT DOCUMENTS

| | | | |
|---|---|---|---|
| DE | 23 04 564 | * | 8/1974 |
| JP | 61-92753 | * | 5/1986 |

OTHER PUBLICATIONS

"Flow Chart of a Typical Foundry Operation", Metalcaster's Reference and Guide, Published by Amercan Foundrymen's Society, p. 1, 1972.*

* cited by examiner

*Primary Examiner*—Kuang Y. Lin
(74) *Attorney, Agent, or Firm*—Dennis Kelly Sullivan; Susan L. Lukasik; Jeffrey P. Calfa

(57) ABSTRACT

The use of green sand is eliminated by replacing green sand molds with all core sand assemblies that provide, during casting, both the internal and external surfaces of a casting, such as a cylinder head or engine block. In the process, a mold is formed from the same core sand that is used to form the core elements defining the internal passageways of the casting. A mold-core carrier is constructed with tapered sides that hold the assembled mold and core elements together during pouring of the molten iron alloy into the mold-core assembly and the cooling period to form the casting. Although the carrier sides can use a refractory liner, preferably the sides are made of replaceable sheet metal backed by an open structural framework to enhance cooling of the casting. After the casting is formed, the core sand from both the mold elements and the core elements is recovered, and may recycled and processed to form further mold elements or core elements or both.

14 Claims, 3 Drawing Sheets

CASTING METHOD AND APPARATUS

This patent application claims the benefit of Provisional U.S. patent application Ser. No. 60/142,334, filed Jul. 2, 1999.

FIELD OF THE INVENTION

This invention relates to methods and apparatus for use in casting, particularly for use in casting large, iron alloy articles such as cylinder heads and cylinder blocks for internal combustion engines.

BACKGROUND OF THE INVENTION

Traditional casting methods generally employ a "green sand" mold which forms the external surfaces of the cast object and the passageways into which the molten iron alloy is poured for direction into the mold cavity. A green sand mold is a mixture of sand, clay and water that has been pressure formed into the mold element. Green sand molds have sufficient thickness so that they provide sufficient structural integrity to contain the molten metal during casting and thereby form the exterior walls of the casting. The structural integrity of the green sand molds, however, is not completely satisfactory and the green sand can easily yield to the pressure that may be exerted by the hands of a workman.

For example, in casting a cylinder head, a green sand mold is provided with a cavity and preformed cavity portions to position and hold core elements that form the exhaust gas, air intake, and coolant passageways and other internal passageways in the cast cylinder head.

The coolant passages are frequently formed with two core elements to permit the interlacing of a one-piece core element forming the plurality of air intake passageways to the cylinders and a one-piece core forming the plurality of exhaust gas passageways from the plurality of cylinders. In such methods, a first element of the coolant core is placed in the green sand mold and core elements forming the passageways for the air intakes, and for the cylinder exhausts are then placed in the green sand mold and the second element of the coolant core is joined with the first element of the coolant core, frequently with the use of adhesive. This method entails substantial labor costs and opportunities for unreliable castings. Where adhesive is used, it is necessary that the workman apply the adhesive correctly so that it will reliably maintain the coolant jacket core elements together during casting. It is also necessary that the workman reliably assemble the two elements of the coolant jacket core during manufacture, and assemble the separate core elements in the green sand mold without damaging the interfacing portions of the green sand mold that reliably position the core elements one with respect to the other. This manufacturing method provides an opportunity for the green sand of the mold to be deformed by a workman in assembly of the core elements within the green sand mold, and an opportunity for a lack of reliability in maintaining a reliable location of the plurality of core elements one to the other. The result is that there is no assurance that the thickness of the internal walls of the cylinder head will be reliably maintained during the manufacture, and there is a substantial risk that unreliable castings will result.

This method was improved by the method set forth in U.S. Pat. No. 5,119,881 issued Jun. 9, 1992. This improved method permits a plurality of inter-engaging one-piece core elements to form an integral core assembly, with interlaced passage-forming portions that are reliably positioned and maintained in position to form a cylinder head with reliable wall thickness and an opportunity to decrease the metal content. In this improved method, a core assembly includes for example a one-piece coolant jacket core, a one-piece exhaust core and a one-piece air intake core, all reliably positioned and held together in an integral core assembly that eliminates the more unreliable core element assembly by manufacturing personnel in the green sand mold. In this improved manufacturing method, the integral core assembly was placed in the green sand mold as a whole prior to pouring the molten iron alloy into the green sand mold.

In such casting, the core elements that form the internal passageways of the cylinder head are formed with a high-grade "core sand" mixed with a curing resin so that core elements may be formed by compressing the core sand-curing agent mixture, and curing the resin while compressed to form core elements that have sufficient structural integrity to withstand handling and the forces imposed against their outer surfaces by the molten metal that is poured into the mold cavity. The core sand resin is selected to degrade at temperatures on the order of 300 to 400 degrees Fahrenheit so that the core sand may be removed from the interior of the cylinder head after the molten iron alloy has solidified.

Because of the cost of the core sand, it is desirable that the sand be recovered for further use after it has been removed from the casting. Recovery of the green sand used in the mold is also desirable; however, the large quantities of the green sand-clay mixture can be degraded sufficiently during the casting process that they cannot be economically recycled and must be hauled away from the foundry and dumped. Since the production of such castings is frequently hundreds of thousands of cylinder heads per year, the cost of handling and disposing of the green sand residue of the casting process imposes a significant unproductive cost in the operation of the foundry. In addition, the core sand frequently becomes mixed with the green sand to such an extent that the core sand cannot be reused in the casting process.

SUMMARY OF THE INVENTION

The invention eliminates the use of green sand by replacing green sand molds with a "core sand" assembly that can provide, during casting, both the internal and external surfaces of the cylinder head or other casting, such as a cylinder block. In the invention, a mold is formed from the same core sand that is used to form the core elements defining the internal passageways of the casting. After the mold and core elements, both of which are formed from core sand, are assembled, they are placed in a carrier with sides that hold the assembled mold and core elements together during pouring of the molten iron alloy into the mold-core assembly and the cooling period during which the molten iron alloy solidifies to form the casting. The carrier for the mold-core assembly may take several forms, including, for example, an insulative shell cast from refractory lining materials used, for example, in lining a smelting furnace. The refractory shell may have sufficient thickness to support the core sand mold-core assembly during pouring operations, or may comprise a thinner walled refractory shell carried within a supporting metal framework. Such refractory shell elements may be used for a multiplicity of casting operations before they need to be discarded or repaired. Preferably, however, the carrier can comprise thin, replaceable metal walls supported by a surrounding supportive structure that is sufficiently "open" to expose outside surfaces of the thin, replaceable walls to the ambient atmosphere for cooling.

In the process of the invention, a plurality of mold carriers are provided and a plurality of core sand mold-core assemblies are provided. The mold-core assemblies comprise core sand mold-forming elements and core sand core-forming elements. The mold-core assemblies are loaded, one after another, into the mold carriers and are transported to a pouring station where the core sand mold-core assemblies are filled with molten metal. The poured mold-core assemblies and carriers are then allowed to cool until the castings are formed and are transferred after the cooling period to an unloading station where the carriers are inverted, the castings are retrieved and the core sand is removed from the interior cavities of the castings. The castings are then ready for inspection and further machining operations, and the core sand is recovered and returned to provide a further plurality of core sand elements, either mold elements or core elements or both.

In the invention, the use of green sand is eliminated by replacing the green sand molds with a combination of reusable, mold-core assembly carriers and mold elements and core elements that are formed by core sand. By eliminating the use of green sand, the cost of the green sand and its clay binders, the problems associated with mixing of the green sand and core sand and their respective binders, and the environmental costs of disposing of the excess green sand are eliminated.

Other features and advantages of this invention will be apparent from the drawings and more detailed description of the invention that follow.

DETAILED DESCRIPTION OF THE BEST MODE OF THE INVENTION

Figure 1:
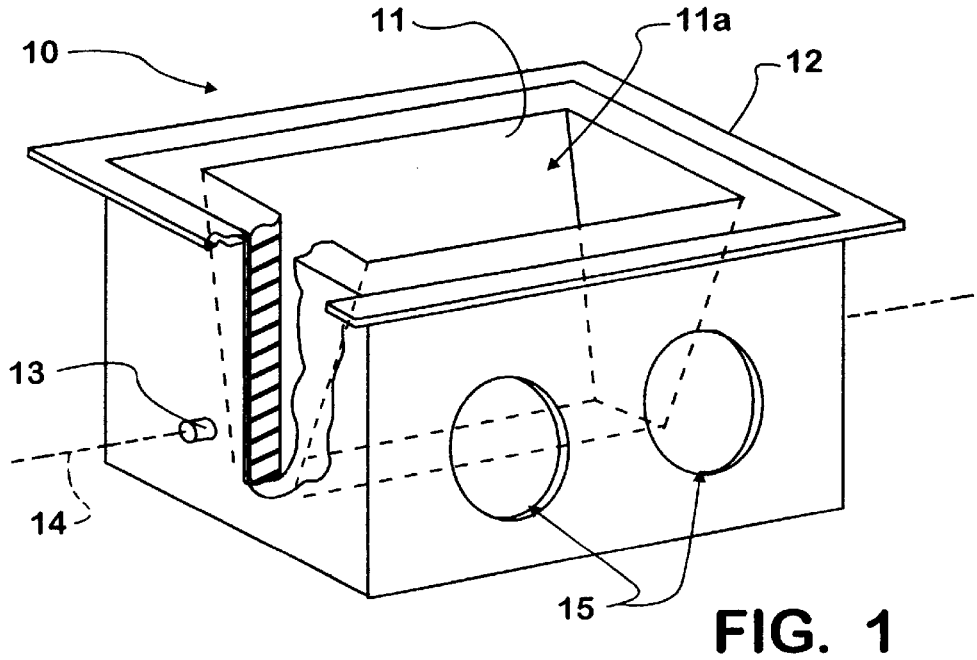
FIG. 1 is a perspective view, partially broken away, of one embodiment of a mold-core assembly carrier used in the invention.
Figure 4:
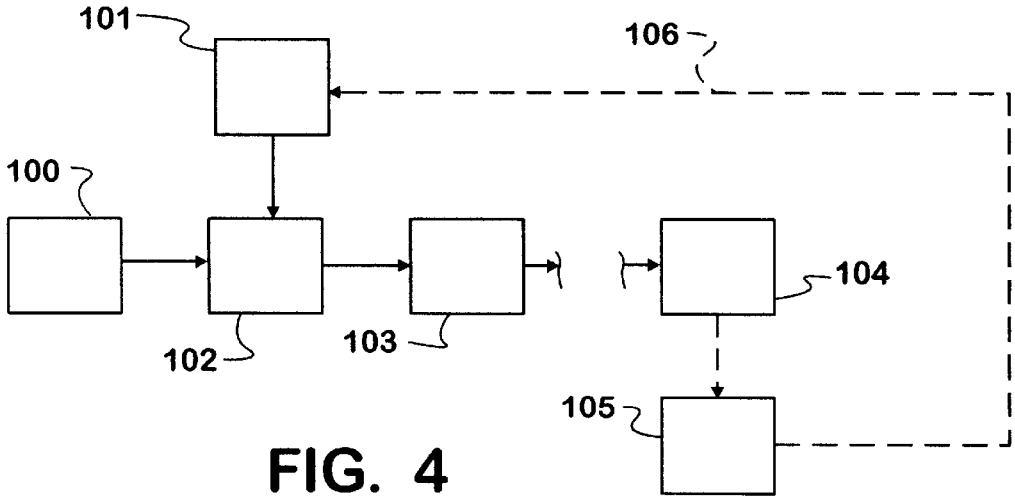
FIG. 4 is a block diagram of the process of the invention.
Figure 5:
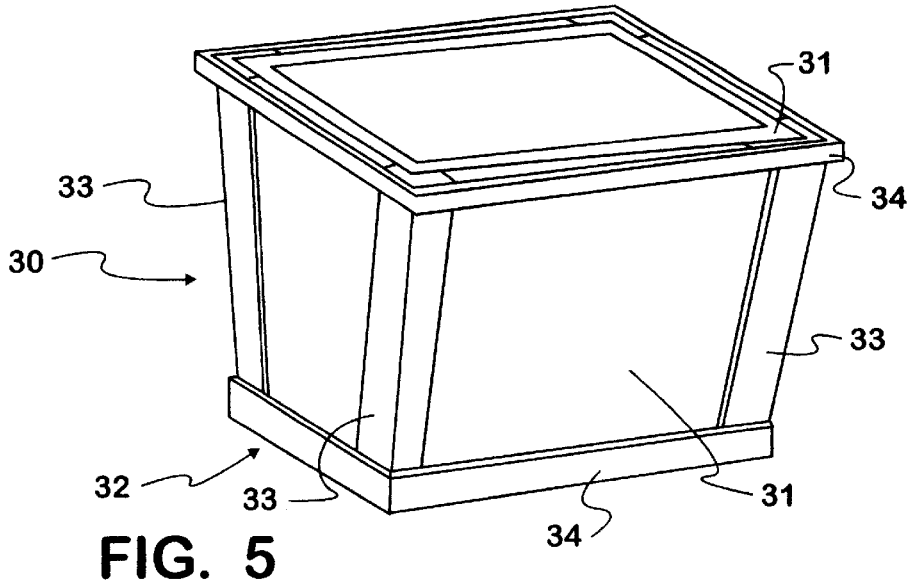
FIG. 5 is a perspective view of another embodiment of a mold-core assembly carrier used in the invention.

FIG. 1 is a perspective view of one embodiment of a mold-core assembly carrier 10 used in the process illustrated in the block diagram of FIG. 4. As illustrated in FIG. 1, the carrier 10 for the mold-core assembly may include a liner 11, formed from a castable refractory material such as the refractory materials used to line the furnaces of iron smelting ovens. Such a refractory liner 11 can be carried in a steel jacket 12. Although FIG. 1 illustrates steel jacket 12 as encompassing the liner 11, except at its open top, with sufficient structural strength in the refractory liner, the steel jacket may be reduced to a supporting steel frame made, for example, from angle and strap iron as shown in FIG. 5. FIG. 1 is partially broken away at one end to illustrate the refractory liner 11.

As further indicated in FIG. 1, steel jacket 12 may be provided with pivot pins 13 located on an axis of rotation 14 below the center of gravity of the carrier 10 so that the carrier 10 will invert unless supported in an upright position. In addition, steel jacket 12 may be optionally provided with one or more openings 15 to permit the refractory liner 11 to be more easily broken out of the steel sleeve 12 if it needs to be replaced.

Figure 2:
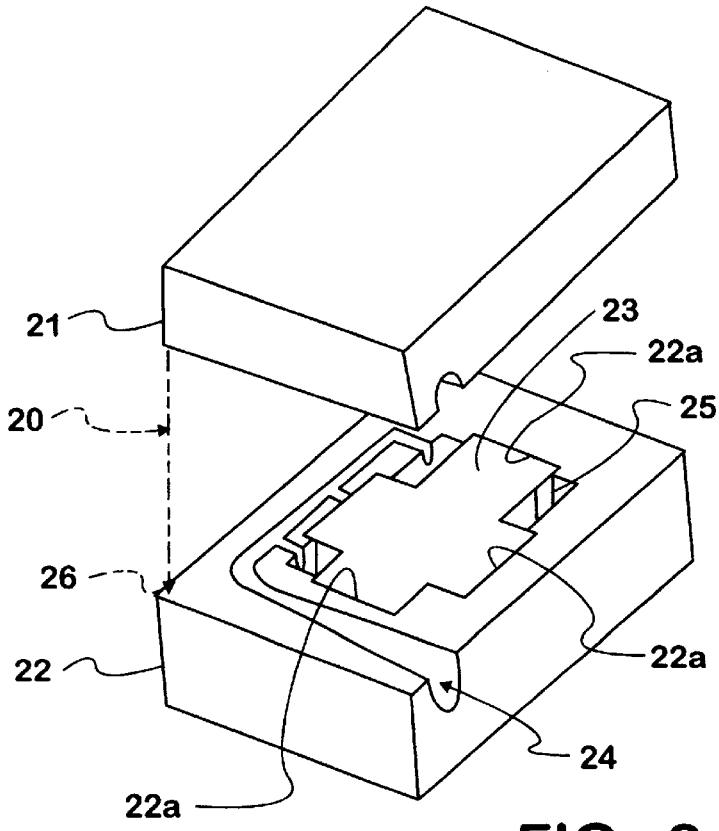
FIG. 2 is a perspective view of a mold-core assembly of the invention, with the mold elements separated to illustrate the internal core assembly.

FIG. 2 illustrates a mold-core assembly 20 including mold elements 21 and 22 that are formed with core sand and resin. As illustrated in FIG. 2, the lower mold element 22 is provided with surfaces 22*a* to position a core assembly 23, which will generally comprise a plurality of assembled core elements, each of which is formed from the core sand used in the mold elements 21 and 22. As further illustrated in FIG. 2, the mold elements 21 and 22 are provided with a passageway 24 into which the molten iron alloy may be poured and carried to fill the mold cavity 25.

In this invention, the core assembly 23 may include interior surfaces that cooperate with the mold halves 21, 22 to form outer surfaces of the casting as well as its interior passageways. For example, the underside of the core assembly 23 may be provided with a cavity portion adjacent a portion of its exterior (on the underside of core assembly 23 and not shown in FIG. 2). Although FIG. 2 illustrates the passageway 24 for the molten iron alloy as being formed in both mold elements 21 and 22, the passageway may be formed predominantly in one mold element. In the mold-core assembly 20, the upper mold element 21 is seated and positioned on the lower mold element 22 as indicated by the dashed, arrowed line 26.

Figure 3:
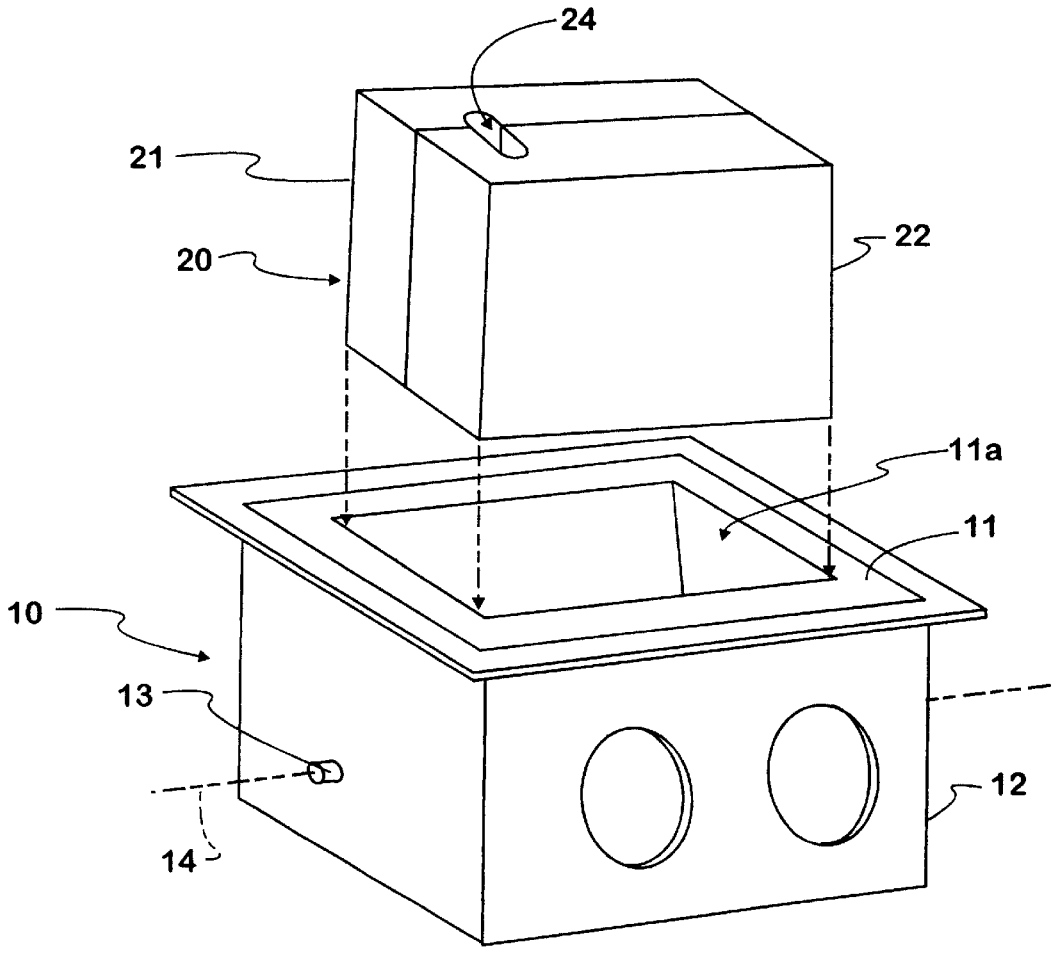
FIG. 3 illustrates the placement of the mold-core assembly of FIG. 2 in the mold-core carrier of FIG. 1.

In the process of the invention, the core assembly 23 is set within the bottom mold element 22 and is positioned therein by positioning surfaces 22*a*, the top mold element 21 is lowered and is positioned on the mold element 22 by inter-engaging mold element surfaces to complete the mold-core assembly 20. The mold-core assembly 20 is then lowered into the central cavity 11*a* of the carrier 10 with the opening 24 for receipt of the molten iron alloy facing upwardly, as shown in FIG. 3. The interior sides of cavity 11*a* may be tapered to allow the weight of the mold-core assembly 20 to retain core elements 21 and 22 in a closed relationship. It will be noted that the taper of the sides of the cavity 11*a* and cavity 40*a* (FIG. 6) is greatly exaggerated for illustrative purposes.

In the process of the invention as illustrated in FIG. 4, a plurality of carriers 10 are provided in first step 100 of the process and a plurality of mold-core assemblies 20, illustrated in FIG. 2, are provided in another first step 101 of the process. The mold-core assemblies 20 are placed in the carriers 10, shown in FIG. 3, at step 102 and are transported to a pouring station 103 where molten iron alloy is poured into the mold-core assemblies 20 through their pour openings 24. The carriers 10 and poured mold-core assemblies 20 are then placed in a holding area for a period, for example, about 45 minutes, to permit the molten iron alloy to solidify and form the casting, the holding period being illustrated in FIG. 4 by the broken line between steps 103 and 104. After the holding period, the carriers 10 are moved to an unloading station 104 where the carriers are permitted to invert, dumping the casting and the remnants of the mold-core assembly for further processing. In the further processing, the core sand from both the mold elements 21 22 and core elements 23 of the mold-core assemblies 20 is recovered at step 105 for return and reuse to provide further mold elements or core elements or both, as shown by line 106. As indicated by line 106, the recovered core sand may be rehabilitated, for example, by supplying it with further resin before using the recovered core sand to provide the mold-core assemblies at step 101.

FIG. 5 illustrates an alternative embodiment of carrier 30 that may be used in the invention, in which the mold-core assembly 20 is to be carried by a relatively thin refractory liner 31. The refractory liner 31 is supported by a structural framework 32, for example, a weldment of angle iron 33 and strap iron 34 spaced so that the combination of structural support 32 and liner 31 support the mold-core assembly 20 during pouring. In a further alternative to this embodiment, the liner 31 may be formed by thin metal sheets supported by a structural framework 32.

Figure 6:
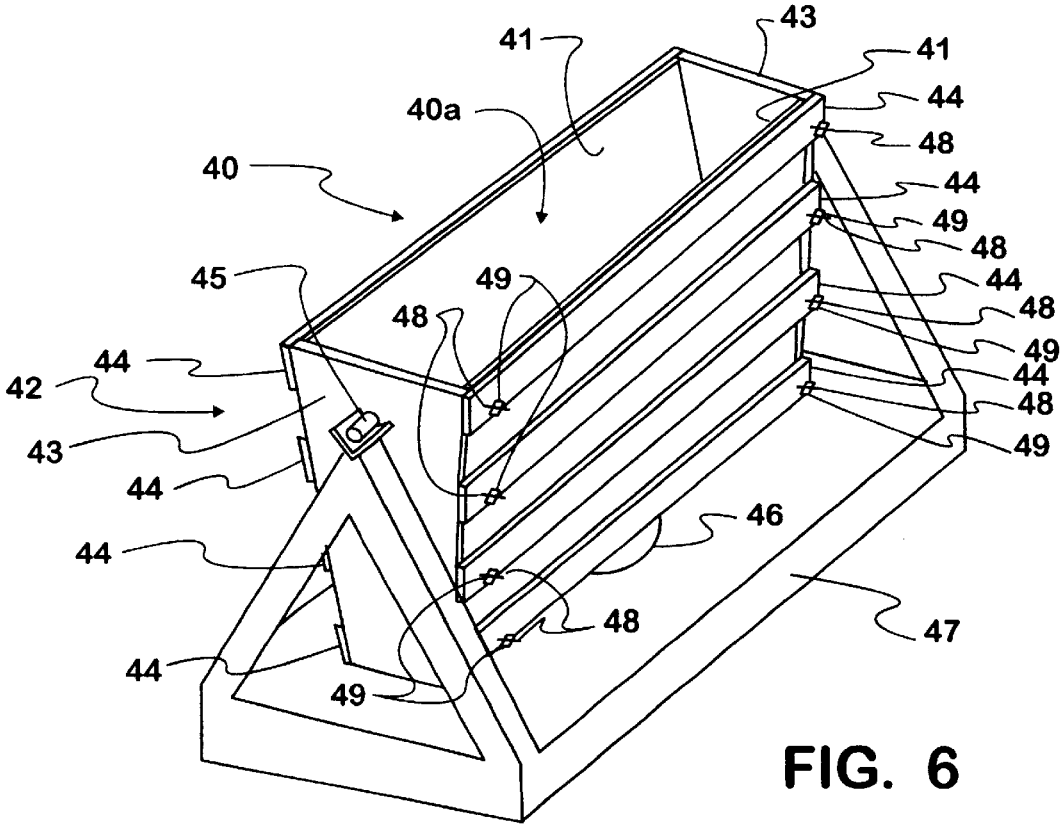
FIG. 6 is a perspective view of a presently preferred embodiment of a mold-core assembly carrier used in the invention.

FIG. 6 illustrates, in a perspective view, a presently preferred embodiment of a mold-core assembly carrier 40 for provision at step 100 of FIG. 4. The preferred mold-core carrier 40 of FIG. 6 does not employ a refractory material liner. Rather, in the carrier 40, two thin replaceable metal sheets 41 are used to engage the sides of the mold-core assembly 20 and, as a result of their positioning, to hold the mold-core assembly together during pouring and cooling of the casting metal (steps 103 and 104 of FIG. 4). The two thin, replaceable metal sheets 41, which can be, for example, steel sheets ¼ inch thick, are inserted into a structural framework 42 and may be held in place by tack welding. The structural framework 42 can comprise a pair of tapered framework ends 43 held in position by a plurality of side slats 44 which are welded at their ends to the framework ends 43. As indicated by FIG. 6, the slats 44 are widely separated to expose the outside surfaces of the thin metal sheets 41 to ambient atmosphere for cooling the casting.

Alternatively, at least one of the metal sheets 41 may be floatably received in the framework, as by a plurality of studs 48 attached to the sheet 41 and extending through the slats 44 wherein lock nuts 49 are spaced on the studs 48 away from the sheet so that the sheet may slide on the studs 48 to seek its own angle as the mold core assembly is inserted in the carrier 40 so that the surface of sheet 41 may conform to the adjacent surface of the mold-core assembly 20 to provide a snug fit therewith during pouring.

The framework ends 43 may be provided with pivot pins 45 to permit inversion of the carrier 40 at the unloading station, step 104. To further assist in unloading the mold-core assembly and casting from the carrier 40, the carrier may be provided with a knock-out mechanism, which can include, for example, a cam 46 operated by a cam-operating surface adjacent to a conveyor on which the inverted carrier 40 is being moved at station 104. FIG. 6 further illustrates a frame 47 for carrying and storing the carrier 40.

In a preferred form of the process of the invention, as illustrated in FIG. 4, a plurality of carriers 40, illustrated in FIG. 6, are provided in first step 100 of the process, and a plurality of mold-core assemblies 20, illustrated in FIG. 2, are provided in another first step 101 of the process. The mold-core assemblies 20 are placed into the central cavities 40*a* of the carriers 40 between the thin replaceable metal sheets 41 through their top openings at step 102 and are transported to a pouring station 103 where molten iron alloy is poured into the mold-core assemblies 20 through their pour openings 24. The carriers 40 and poured mold-core assemblies 20 are then placed in a holding area for a period, for example, about 45 minutes, the holding period being illustrated in FIG. 4 by the broken line between steps 103 and 104, to permit the molten iron alloy to solidify and form the castings. After the holding period the carriers 40 are moved to an unloading station 104 where the carriers are inverted and their knock-out mechanisms are operated, for example, by the engagement of cam 46 with a cam-operating surface at unloading station 104, dumping the casting and the remnants of the mold-core assembly for further processing. In the further processing, the core sand from both the mold elements 21, 22 and core elements 23 of the mold-core assemblies 20 is recovered at step 105 for return and reuse to provide further mold elements or core elements or both, as shown by line 106. The recovery step may include both screening to separate the core sand from the other casting residue and magnetic screening of the recovered core sand to remove any metal particulate matter. As indicated by line 106, the recovered core sand may be rehabilitated, for example, by supplying it with further resin before using the recovered core sand to provide the mold-core assemblies at step 101.

In addition, the step of recovering and processing the core sand to provide a further plurality of mold elements and/or core elements can include the steps of rehabilitating recovered core sand by the addition of further binder and mixing the recovered core sand and new core sand, as needed, to form a further plurality of mold elements and/or core elements for the mold-core assembly.

Other embodiments and applications of the invention will be apparent to those skilled in the art from the drawings and methods of the invention described above without departing from the scope of the claims that follow. For example, although taught in connection with a cylinder head casting, the invention may be applied to other castings, such as engine blocks, transmission housings, and large valves housings, with little modification.

What is claimed is:

1. A casting method for castings having internal passages, comprising:

providing a plurality of carriers, said carries including an open top and an interior formed by a pair of sides that converge downwardly and pair of side-supporting ends;

providing a plurality of mold elements formed from core sand with a mold cavity for the formation of the outer walls of the castings;

providing a plurality of core elements formed from core sand for forming the internal passageways of the castings;

assembling the mold elements and core elements into a plurality of mold-core assemblies;

loading the mold-core assemblies, one at a time, into the open tops of the carriers;

transporting the mold-core assemblies and carriers to a pouring station said carriers through their downwardly converging sides holding the mold assembly together within the carriers, and pouring molten metal into the mold assemblies, wherein each mold-core assembly has a top opening that permits molten metal to be poured downwardly through the open top of the carriers;

allowing the molten metal solidify into castings;

uploading the castings and mold-core assemblies in an unloading station;

recovering the core sand of the mold elements and core elements; and rehabilitating the recovered core sand and returning it for use to provide mold elements and core elements.

2. The method of claims 1 wherein the step of rehabilitating the recovered core sand includes the addition of further binder and the mixing of the recovered core sand and new core sand as needed to form mold elements and core elements of the mold-core assembly.

3. The method of claim 1 wherein the casting and mold-core assemblies are unloaded by inverting the carriers and dumping their contents.

4. The method of claim 3 wherein the carriers includes pivot pins and the carriers are inverted about their pivot pins.

5. The method of claim 1 wherein the core sand is recovered by a screening process.

6. The method of claim 1 wherein the recovered core sand is rehabilitated by magnetic screening to remove particulate metal.

7. The method of claim 3 wherein the carriers include knock-out mechanisms operated after their inversion to assist dumping the contents of the carriers.

8. The method of claim 7 wherein the knock-out mechanisms include a cam operated surface that is engaged and operated as the carriers are moved by a conveyor.

9. A cod apparatus for a casting having internal passages, comprising a mold core assembly including mold elements formed from core sand, joined at a vertical parting line, and defining a mold cavity for the formation of an outer wall of a casting;

a core element disposed within said mold cavity formed from core sand and defining an internal passageway of the casting; and a mold-core assembly carrier having sides that converge downwardly and end plates, and defining an internal cavity having an open top, said mold-core assembly being disposed thereinside and retained together in defining the mold cavity by its engagement with the downwardly converging sides of the mold-core assembly carrier, wherein each mold-core assembly has a top opening that permits molten metal to be poured downwardly through the open top of the carriers.

10. The casting apparatus of claim 9 wherein the mold-core carrier sides comprise open frame structures and thin steel side sheets disposed between the open fame structures and the mold-core assemblies.

11. The casting apparatus of claim 10 wherein the thin steel side sheets are attached to the frame structure.

12. The casting apparatus of claim 11 wherein the thin steel side sheets are replaceably attached to the frame structure.

13. The casting apparatus of claim 10 wherein a steel side sheet is floatingly attached to the frame structure to permit the angle of the side sheet to conform to the angle of the adjacent surface of the mold-core assembly.

14. The casting apparatus of claim 9 wherein the mold-core carrier is lined with refractory material.

* * * * *